United States Patent [19]

Shepherd

[11] Patent Number: 5,064,256

[45] Date of Patent: Nov. 12, 1991

[54] LATERAL FILE CABINET

[75] Inventor: Donald A. Shepherd, Spring Lake, Mich.

[73] Assignee: Herman Miller, Inc., Zeeland, Mich.

[21] Appl. No.: 525,887

[22] Filed: May 17, 1990

[51] Int. Cl.[5] ..... E05C 7/06

[52] U.S. Cl. ..... 312/221; 312/222; 312/327

[58] Field of Search ..... 312/322, 323, 327, 328, 312/221, 222

[56] References Cited

U.S. PATENT DOCUMENTS

| | | | |
|---|---|---|---|
| 403,168 | 5/1889 | Wood | 312/323 |
| 622,335 | 4/1899 | Eales . | |
| 741,434 | 10/1903 | Anderson | 312/323 |
| 803,070 | 10/1905 | Schmidt | 312/323 |
| 952,573 | 3/1910 | Munger . | |
| 1,318,306 | 10/1919 | Walker . | |
| 1,556,008 | 10/1925 | Boumphrey . | |
| 1,732,173 | 10/1929 | Svendsgaard . | |
| 1,925,725 | 9/1933 | Auerbach . | |
| 2,506,533 | 5/1950 | Winborne . | |
| 2,526,422 | 10/1950 | Roberts . | |
| 2,639,957 | 5/1953 | Geller . | |
| 2,674,511 | 4/1954 | Minor . | |
| 2,785,036 | 3/1957 | Elsden-King et al. . | |
| 2,853,352 | 9/1958 | Gittins . | |
| 3,078,133 | 2/1963 | Schauer . | |
| 3,117,828 | 1/1964 | Wright . | |
| 4,492,418 | 1/1985 | Bailey | 312/222 |
| 4,616,891 | 10/1986 | Jantzen . | |
| 4,822,119 | 4/1989 | Compton . | |
| 4,892,367 | 1/1990 | Jantzen . | |

*Primary Examiner*—Kenneth J. Dorner
*Assistant Examiner*—Gerald A. Anderson
*Attorney, Agent, or Firm*—Varnum, Riddering, Schmidt & Howlett

[57] ABSTRACT

A lateral file cabinet having at least two drawers and wherein the drawers are mounted for forward and outward tilting movement so as to provide access to the interior of each drawer. A principle feature of the file cabinet is that when one drawer is open, the other drawer of a two drawer file cabinet cannot be opened. An open lower drawer prevents a next upper drawer from being opened and an opened upper drawer prevents a next lower drawer from being opened.

10 Claims, 4 Drawing Sheets

LATERAL FILE CABINET

BACKGROUND OF THE INVENTION

1. Field of the Invention

This invention relates generally to new and useful improvements in lateral file cabinets and, more particularly, to lateral file cabinets wherein the drawers rotatably tilt out of the cabinet for access from the top of the drawers.

2. Description of the Related Art

A problem often associated with file cabinets is that if more than one drawer is extended or opened at a time, the weight of the drawers and the contents stored within the drawers that project forwardly of the file casing create a tendency for the file cabinet to overturn. In order to overcome this hazard some file cabinets incorporate drawer interlocks or mechanisms which prevent the simultaneous extension of more than one file drawer. Such mechanisms can be quite elaborate and can add considerably to the cost of the file cabinet. Furthermore, the mechanisms may occupy a substantial volume of valuable storage space within the file casing interior.

In other file cabinets presently known, the file drawers are pivotally mounted within the file casing interior such that they "tilt out" laterally rather than "slide out" longitudinally. Such cabinets can be referred to as lateral filing cabinets and are advantageous in that they occupy less space when the drawers are in an open position than do file cabinets having conventional drawers that slide out along the drawer longitudinal axis. An objective in tilt out lateral file cabinet construction is to reduce the area or volume of the drawer that projects forwardly of the file casing, thereby reducing the tendency for the cabinet to overturn. The majority of the combined weight of the drawer and the stored contents is contained within the interior of the file casing, even when several file drawers are opened, which provides a relatively stable configuration in which the likelihood of the file cabinet overturning is reduced. However, these file cabinet constructions are a compromise because access to the file drawer interior is limited. Most of the file drawer is carried inside the file cabinet casing even when the drawer is in the open position.

For example, in U.S. Pat. No. 2,785,036, issued Mar. 12, 1957 to H. E. Elsden-King, et al., no more than 25% of the side elevational area of a drawer moves outside the file casing which limits access to contents stored in the rear of the drawer. In U.S. Pat. No. 4,822,119, issued Apr. 18, 1989 to A. Compton, the individual file drawers are projected at different angles and are contained virtually entirely within the cabinet casing, which too limits access to the drawers. Furthermore, when the drawers are in the closed position, a smooth, uniform, aesthetically pleasing appearance is not possible. In U.S. Pat. No. 4,616,891, issued Oct. 14, 1986 to E. Jantzen, trough-like drawers having cylindrical bottom wall portions are utilized. However, these drawers are not conducive to storing files and other traditional office materials which are best contained in a more or less square or rectangular file drawer or at least a drawer having a substantially flat bottom wall.

Thus, there is need for a lateral filing cabinet in which the drawers are rotatably mounted to the file casing and which project sufficiently forward of the casing so as to enhance visibility of the stored contents. It would be advantageous if the file drawers could be of a generally square or rectangular construction to facilitate storage of traditional office materials. It would also be advantageous if the file cabinet incorporated an economical, space saving drawer interlock that stabilizes the cabinet by preventing the simultaneous opening of more than one drawer.

SUMMARY OF THE INVENTION

The invention relates to a lateral file cabinet having drawers which tilt out to an open position. The drawers cooperate with one another so that two adjacent drawers cannot be simultaneously tilted out to an open position.

More particularly, the invention relates to a lateral file cabinet having a file casing and two drawers, one above the other. The drawers tilt out to have the entire top of each drawer exposed for access to files stored therein. There is cooperation between a closed drawer and an open drawer which limits the outward tilting of the open drawer. The drawers are so related to one another that when, for example, the lower drawer is tilted out, the upper drawer cannot be tilted out and, in a like manner, when the upper drawer is tilted out, the lower drawer cannot be tilted out.

Furthermore, each drawer is of substantially boxlike construction and includes an open top portion. The boxlike construction facilitates storage of traditional office materials. Each drawer is hinged such that when in the open position more than 25% of the drawer side elevational area projects forwardly of the file casing thereby maximizing visibility of the drawer interior and contents stored within the drawer.

With the above and other objects in view that will hereinafter appear, the nature of the invention will be more clearly understood by reference to the following detailed description, the appended claims, and the several views illustrated in the accompanying drawings.

BRIEF DESCRIPTION OF THE DRAWINGS

The invention will now be described with reference to the following drawings in which.

DETAILED DESCRIPTION OF THE PREFERRED EMBODIMENTS

Figure 1:
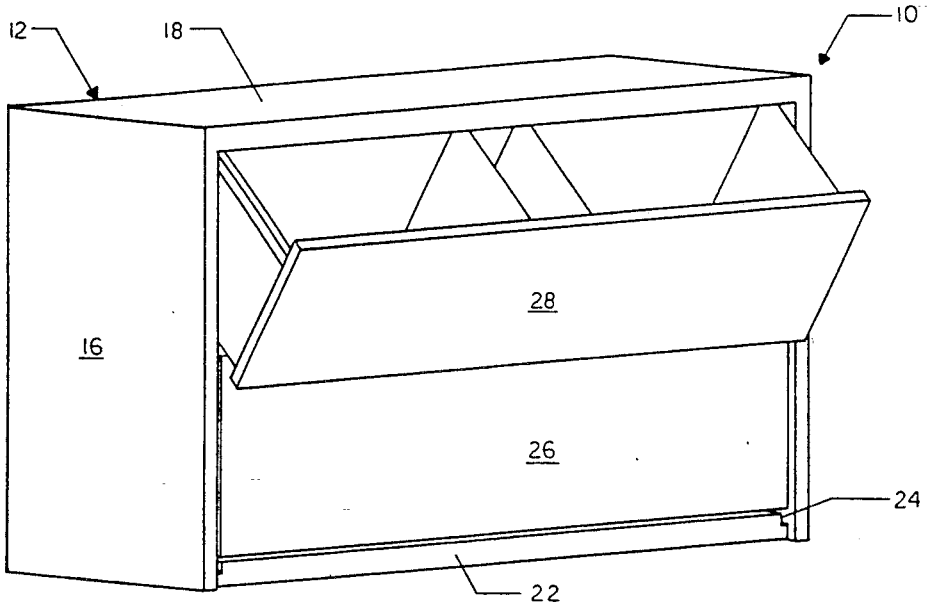
FIG. 1 is a front perspective view of a file cabinet according to the invention and showing an upper drawer thereof in a tilted out open position and a lower drawer thereof in a closed position.
Figure 2:
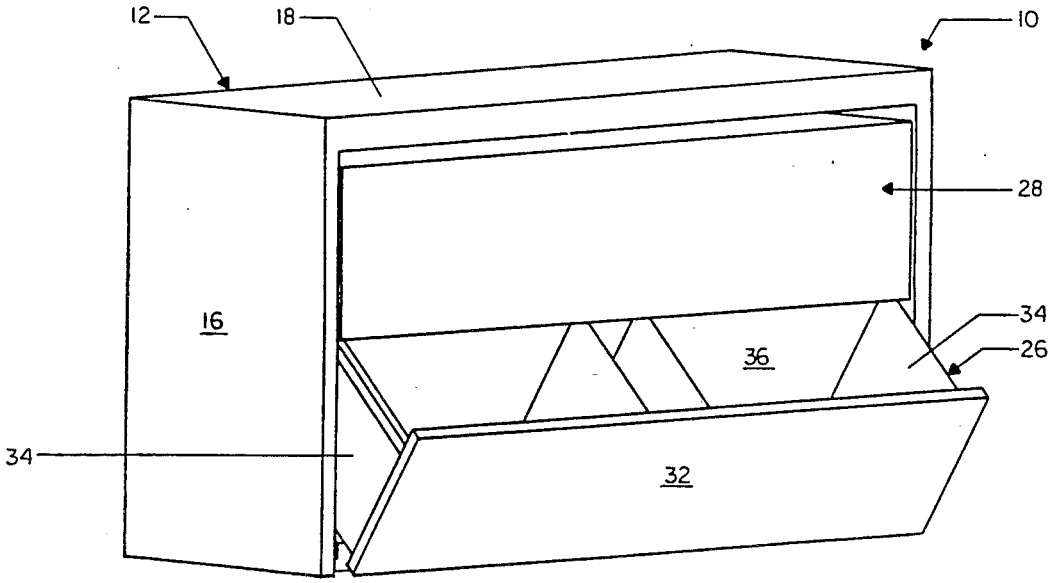
FIG. 2 is a front perspective view similar to FIG. 1 but showing the upper drawer in a closed position and the lower drawer in a tilted out open position.
Figure 3:
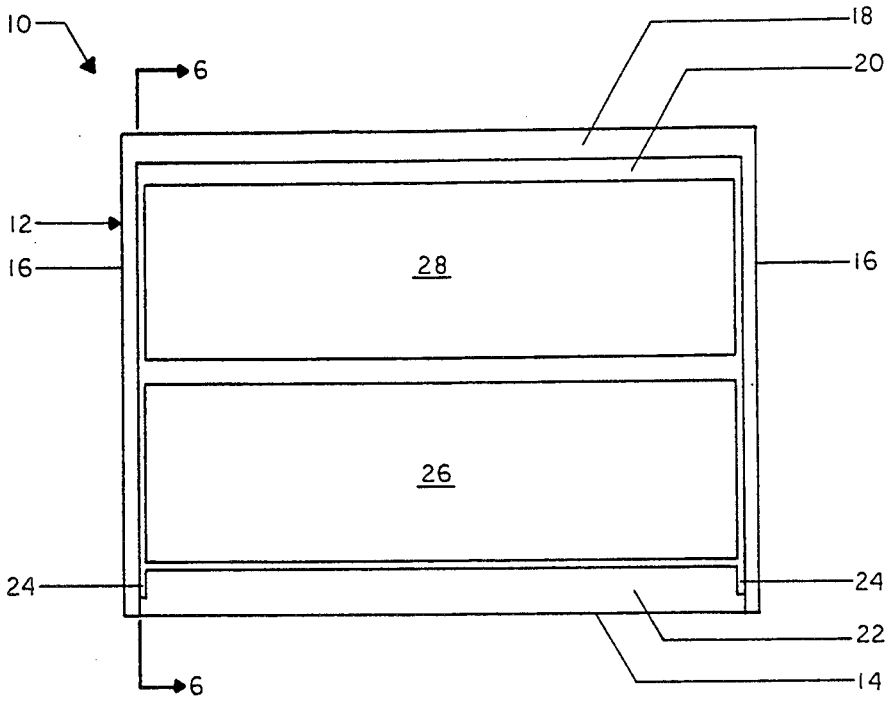
FIG. 3 is a front elevational view of the cabinet of FIGS. 1 and 2 and showing generally the relationship of the file drawers with respect to one another and to a file casing.
Figure 6:
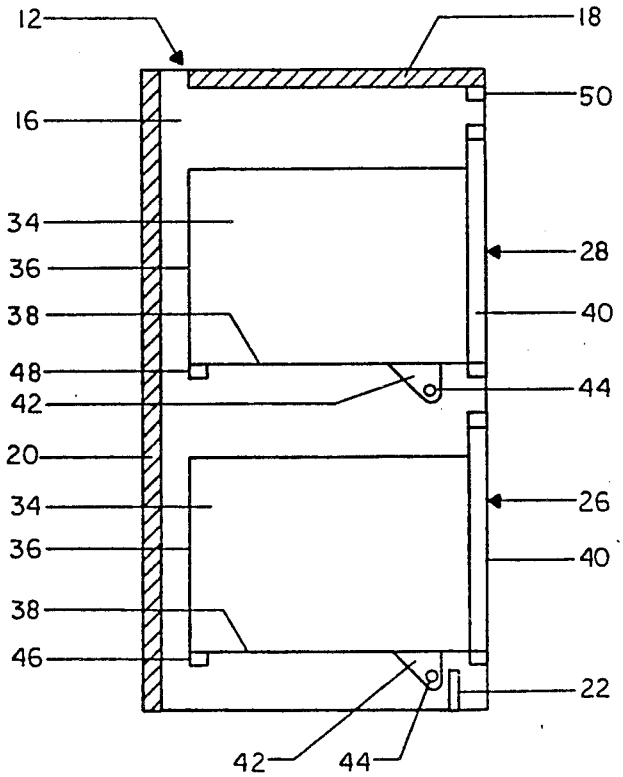
FIG. 6 is a vertical sectional view along lines 6—6 of FIG. 3 and showing in solid lines each drawer in the closed position and further showing in interrupted lines each drawer in the open position.

Referring now to the drawings in detail, there is illustrated in FIGS. 1 to 3 a lateral file cabinet formed in accordance with this invention, the lateral file cabinet being generally identified by the reference numeral 10. The lateral file cabinet 10 includes a file casing 12 which is of a generally rectangular configuration and which includes a base 14, upstanding side walls 16, a top wall 18, and a rear wall 20. The base 14 also includes an upstanding front or trim panel 22 which is rearwardly recessed as is best shown in FIG. 6. The front panel 22 is provided with, adjacent opposite ends thereof, vertical notches 24 the purpose of which will be set forth in greater detail hereinafter. Mounted within the file casing 12 for outward tilting movement are two drawers, a lower or bottom drawer 26 and an upper or top drawer 28.

Figure 4:
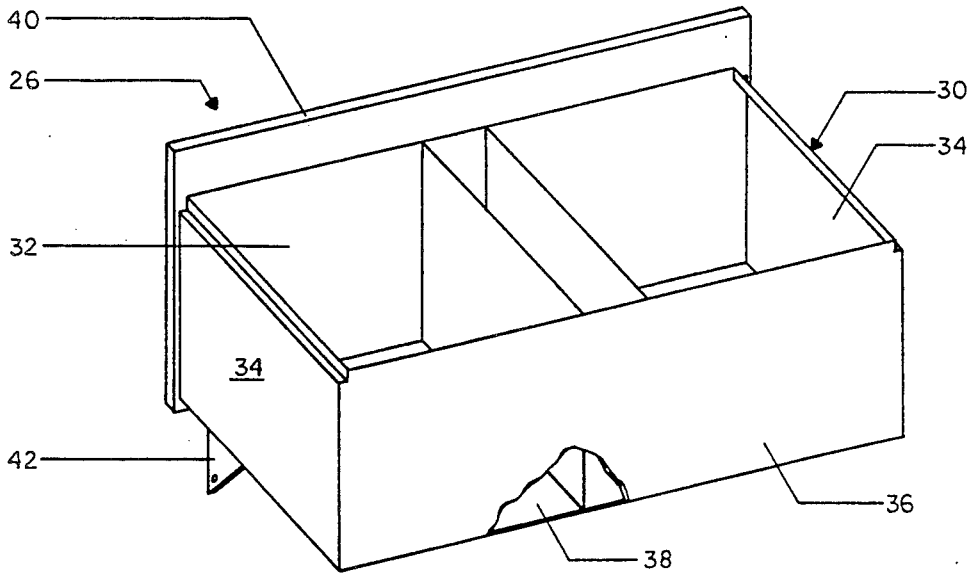
FIG. 4 is a top rear perspective view of the lower drawer of the file cabinet of FIGS. 1 to 3.
Figure 5:
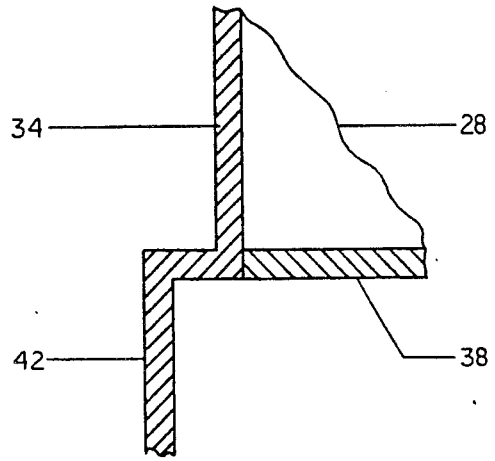
FIG. 5 is a fragmentary vertical sectional view taken through a lower portion of the upper drawer and showing an outward offsetting of a hinge member for the upper drawer.

The specific details of construction of the lower drawer 26 are best shown in FIG. 4. The lower drawer 26 includes a boxlike member 30, which is preferably formed of metal, comprising a front panel 32, a pair of side panels 34, a rear panel 36, and a bottom panel 38. The boxlike member 30 can be partitioned into multiple storage compartments if desired. Suitably attached to the front panel 32 is a heavy duty face plate 40 which projects both slightly downwardly below the bottom panel 38 and a considerable distance above the upper edge of the boxlike member 30. Each side panel 34 is provided with, adjacent to the front edge thereof, a depending, generally triangular hinge member 42. The hinge members 42 are connected to the side walls 16 of the file casing 12 by way of hinge pins 44 (FIG. 6). The hinge members 42 of the lower drawer 26 can be planar continuations or extensions of the side panels 34, as best shown in FIG. 3. Each hinge member 42 defines a pivot axis which is stationary and about which the respective drawer 26, 28 rotates for pivoting movement.

The structure of the upper drawer 28 is substantially similar to that of the lower drawer 26 and like or analogous components bear identical reference numerals. However, hinge members 42' of the upper drawer 28 must be outwardly offset relative to the drawer side panels 34 rather than being planar extensions thereof so that the upper drawer can clear the boxlike member 30 of the lower drawer when the upper drawer is opened, as explained more fully hereinbelow.

Referring now to FIG. 6, the lower drawer 26 is mounted within a lower portion of the file casing 12 and spaced away from an upper edge of the trim panel 22. The lower drawer 26 normally is supported in a recessed horizontal position by the forwardly located hinge pins 44 and a rear support 46 which extends between the casing sidewalls to support the drawer bottom panel 38. In a like manner, the upper drawer 28 is supported within the file casing 12 above the lower drawer 26 by hinge pins 44 and a rear support 48. The face plates 40 of the drawers 26 and 28 lie in a common vertical plane with a lower edge of the upper drawer face plate 40 being spaced above the projecting upper edge of the lower drawer face plate 40. In a like manner, the upper edge of the face plate 40 of the upper drawer 28 is spaced below a trim strip 50 secured to an underside of the top wall 18 at the front of the filing casing 12.

Figure 7:
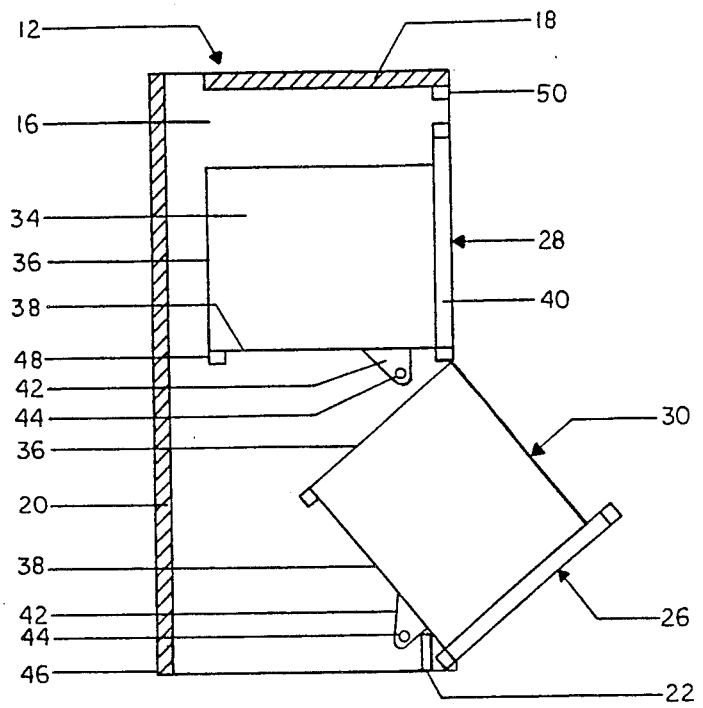
FIG. 7 is a vertical sectional view similar to FIG. 6 but showing the lower drawer in the tilted out open position blocking outward tilting of the upper drawer to the open position.

When the lower drawer 26 is moved to the tilted out open position, as best shown in FIGS. 6 and 7, it will freely swing forwardly and outwardly with the hinge members 42 therefor entering the notches 24 formed in the front panel 22. The hinge members 42 seat in the bottom of the notches 24 and thus limit the outward tilting movement of the lower drawer 26. It is to be noted that the outward tilted position of the lower drawer 26 is one wherein ready access is had to the entire top of the boxlike member 30 of the drawer and hence the drawer interior where the drawer contents are stored.

With continued reference to FIGS. 6 and 7, it will be seen that with the lower drawer 26 in its outwardly tilted access position, an attempt to open the upper drawer 28 is frustrated. As the face plate 40 of the upper drawer 28 attempts to swing downwardly, the lowermost portion thereof engages the rear panel 36 of the lower drawer 26, thereby preventing continued outward tilting movement of the upper drawer which retains the upper drawer in the closed position. Further, even if the face plate 40 of the upper drawer 28 should clear the rear panel 36 of the lower drawer 26, the bottom panel 38 of the upper drawer 28 soon engages the rear panel 36 of the lower drawer 26, thereby limiting the outward tilting movement of the upper drawer 28.

Figure 8:
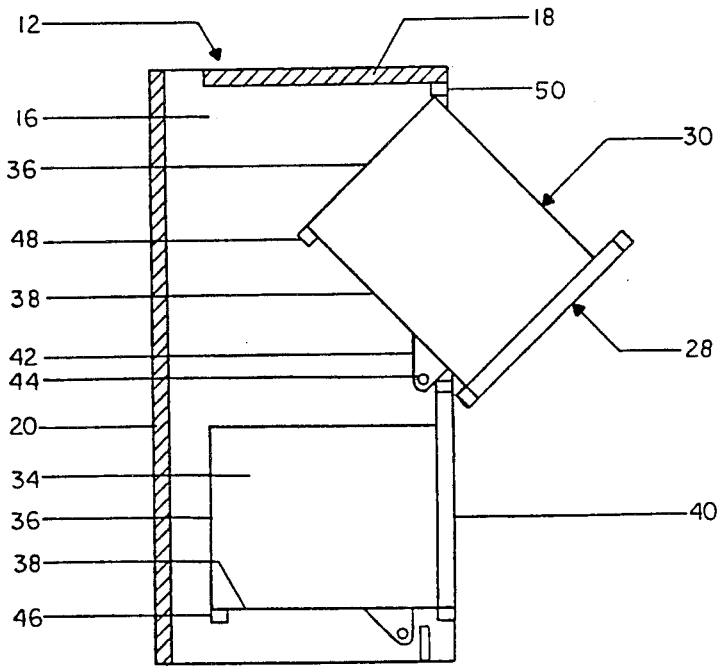
FIG. 8 is a vertical sectional view similar to FIG. 7 but showing the upper drawer in the tilted out open position blocking outward tilting of the lower drawer to the open position.

Referring now to FIG. 8, it will be seen that the lateral filing cabinet 10 is illustrated with the upper drawer 28 tilted out to the open position. In this position, the bottom panel 38 of the upper drawer 28 contacts the upper edge of the face plate 40 of the lower drawer 26 so as to restrict further outward tilting movement. The same contact also prevents the outward tilting of the lower drawer 26 to the open position.

It is feasible to proportion the file casing 12 and the drawers 26 and 28 so that outward tilting movement of the lower drawer 26 can be limited by engagement of the upper rear portion of the boxlike member 30 of the lower drawer 26 with a lower edge of the face plate 40 of the upper drawer 28. In the same manner, the outward tilting of the upper drawer 28 can be limited by the engagement of the upper rear portion of the boxlike member 30 of the upper drawer with the trim strip 50.

While the construction of the file cabinet 10 is preferably intended to be restricted to two drawers, the principles of the invention may equally as well be utilized in a file cabinet having a larger number of drawers. For example, the opening of a lower drawer will automatically prevent the opening of the next upper drawer and, therefore, even with a four drawer file cabinet, it is only possible to open two of the drawers at a time.

With reference to FIGS. 6 to 8, it can be seen that approximately 50% of the side elevational area of a drawer in the open position projects forwardly of the file cabinet casing thereby maximizing the visibility of the drawer interior and the contents stored therein. The side elevational area of the drawer is determined by reference to the height and length of the drawer side panels. Because movement of one file drawer to the open position frustrates movement of the other file drawer to the open position, it is possible to configure the drawer hinging means such that more than 25% of the side elevational area of a file drawer projects forwardly of the file cabinet casing when the drawer is in the open position. This enhances the efficiency and functionality of the cabinet because visibility of the drawer interior and the contents stored therein is increased.

It should also be noted that a file cabinet according to the invention incorporates substantially rectangular, boxlike drawers having flat bottom walls. A boxlike construction facilitates the storage of files, folders, papers and other traditional office materials. As noted hereinabove in the Background, presently known lateral file cabinets do not allow for more than 25% of the side elevational area of a drawer to project forwardly of the file cabinet casing when the drawer is in the open position or, if they do, the drawer is of a shape that is not conductive to storing traditional office materials. The unique arrangement for preventing the simultaneous withdrawal of more than one file drawer makes possible a construction in which a substantially boxlike drawer is projected forwardly of the file cabinet casing to a considerable degree, thereby maximizing visibility of the drawer interior.

Although only a preferred embodiment of the file cabinet has been illustrated and described herein, it is to be understood that minor variations may be made in the file cabinet construction without departing from the spirit and scope of the invention as defined by the appended claims.

The embodiments for which an exclusive property or privilege is claimed are defined as follows:

1. A lateral file cabinet comprising a casing, at least two drawers, including a lower drawer and a next upper drawer, each of said drawers is of boxlike construction and includes a front panel having a top edge and a lower edge, an open top portion, a back panel and a bottom panel, and a hinge for each drawer, said hinges mounting said drawers to said casing for tilting movement partially out of said casing to provide access to the interior of each drawer, and cooperating means between said drawers restricting outward tilting movement to only one of said two drawers at a time, said cooperating means include the back panel of said lower drawer in cooperation with the lower edge of said front panel of said upper drawer when said lower drawer is in the open position.

2. A lateral file cabinet according to claim 1 wherein said cooperating means further includes the bottom panel of the upper drawer.

3. A lateral file cabinet according to claim 1 wherein said casing includes a lower trim panel mounted to the front of said casing, and said hinge of said lower drawer includes a hinge member which abuts said lower trim panel to limit outward pivoting of said lower drawer.

4. A lateral file cabinet according to claim 3 wherein said lower trim panel includes a portion defining a notch said notch being adapted to receive said hinge member of said lower drawer, and further wherein the depth of said notch limits the outward pivoting of said lower drawer.

5. A lateral file cabinet according to claim 4 wherein each drawer is of an open top boxlike construction including a front panel, and a bottom of said upper drawer engages a top of said front panel of said lower drawer to limit outward pivoting of said upper drawer.

6. A lateral file cabinet according to claim 1 wherein the bottom of said upper drawer engages a top of said front panel of said lower drawer to limit outward pivoting of said upper drawer.

7. A lateral file cabinet according to claim 1 wherein each drawer is movable between an open position and a closed position, when said lower drawer is in the open position, and said upper drawer is in the closed position, wherein engagement of said upper drawer with said lower drawer frustrates movement of said upper drawer to the open position thereby retaining said upper drawer in the closed position.

8. A lateral file cabinet according to claim 1 wherein each drawer is movable between an open position and a closed position, when said upper drawer is in the open position, and said lower drawer is in the closed position, wherein engagement of said lower drawer with said upper drawer frustrates movement of said lower drawer to the open position thereby retaining said lower drawer in the closed position.

9. A lateral file cabinet comprising a casing, at least two drawers, including a lower drawer and a next upper drawer, each of said drawers is of boxlike construction and includes a front panel having a top edge and a lower edge, an open top portion, a back panel and a bottom panel, and a hinge for each drawer, said hinges mounting said drawers to said casing for tilting movement partially out of said casing to provide access to the interior of each drawer, and cooperating means between said drawers restricting outward tilting movement to only one of said two drawers at a time, said cooperating means including the lower portion of said upper drawer in cooperation with the top edge of said front panel of said lower drawer when the upper drawer is in the open position, and the back panel of said lower drawer in cooperation with the lower edge of said front panel of said upper drawer when said lower drawer is in the open position.

10. A lateral file cabinet according to claim 9 wherein more than 25% of the side elevational area of a drawer moves outside of said casing when said drawer is in the open position.

* * * * *